US007467864B2

(12) United States Patent
Matsui et al.

(10) Patent No.: US 7,467,864 B2
(45) Date of Patent: Dec. 23, 2008

(54) RECORDING HEAD, HEAD CARTRIDGE AND RECORDING APPARATUS

(75) Inventors: Takahiro Matsui, Tokyo (JP); Yoshiyuki Imanaka, Kanagawa (JP); Souta Takeuchi, Kanagawa (JP); Takuya Hatsui, Tokyo (JP); Takaaki Yamaguchi, Kanagawa (JP); Kousuke Kubo, Kanagawa (JP); Souhei Tanaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 11/474,986

(22) Filed: Jun. 27, 2006

(65) Prior Publication Data

US 2007/0002087 A1 Jan. 4, 2007

(30) Foreign Application Priority Data

Jun. 30, 2005 (JP) ..... 2005-193083

(51) Int. Cl.
*B41J 2/175* (2006.01)

(52) U.S. Cl. ..... 347/87; 347/5; 347/9; 347/10; 347/11; 347/19; 347/49; 347/50

(58) Field of Classification Search ..... None
See application file for complete search history.

(56) References Cited

U.S. PATENT DOCUMENTS

| | | | | |
|---|---|---|---|---|
| 5,828,386 | A | 10/1998 | Okada et al. | |
| 6,471,324 | B1 * | 10/2002 | Maru | 347/19 |
| 2006/0238558 | A1 | 10/2006 | Hatasa et al. | |

FOREIGN PATENT DOCUMENTS

| | | |
|---|---|---|
| JP | 8-252909 | 10/1996 |

* cited by examiner

*Primary Examiner*—Luu Matthew
*Assistant Examiner*—Justin Seo
(74) *Attorney, Agent, or Firm*—Fitzpatrick, Cella, Harper & Scinto

(57) ABSTRACT

In a connection status output circuit for confirming the connection status with a recording apparatus via connecting terminals corresponding respectively to recording signal DATA, clock signal CLK for transferring the recording signal, and control signals LT and HE for controlling a recording operation according to the recording signal, the signals being received from the recording apparatus, when the connection status is confirmed, a signal designating the connection status is outputted, and when a recording operation is performed, the output signal does not change.

9 Claims, 17 Drawing Sheets

RECORDING HEAD, HEAD CARTRIDGE AND RECORDING APPARATUS

FIELD OF THE INVENTION

The present invention relates to a recording head, a head cartridge and a recording apparatus, and more particularly to a circuit disposed within a recording head for confirming the connection status between a recording head and a recording apparatus.

BACKGROUND OF THE INVENTION

As an information output apparatus, for example in a word processor, a personal computer, a facsimile machine or the like, printers for recording information, such as characters and images, on a sheet type recording medium such as printing paper or a film, have been broadly used.

As a typical liquid (ink) discharging type in recording heads mounted on inkjet recording apparatuses, a type using an electromechanical transducer such as a piezoelectric device, and a type using thermal energy are known. Inkjet recording heads have been put broadly into practical use, which heat liquid by an electrothermal conversion element (heater) and allow droplets to be discharged by an operation of film boiling. The configuration is such that an electrothermal conversion element is disposed within an ink chamber, and an electric pulse acting as a recording signal is supplied to this element to heat it, whereby thermal energy is supplied to the liquid. Then, by utilizing bubble pressure of liquid caused by a phase change of liquid when bubbled, very small droplets are discharged from a tiny discharge aperture (nozzle) to perform recording on a recording medium.

Further, there is another type recording system as an improved type for the above-mentioned type, wherein ink droplets are made uniformly by communicating bubbles with air, and discharge of minute droplets are performed. According to this type of recording, it becomes possible to secure a stable discharge amount of such minute ink droplets and to attain a high quality printing.

A recording apparatus provided with the above described inkjet recording head uses in addition to black ink being monochrome type ink liquid, color type ink liquids (inks) of cyan, magenta and yellow, and is provided with recording heads of the above described type, each corresponding to the kind of ink used.

Generally, due to the trend toward high image quality, the number of discharge apertures of each recording head section has increased to 64-128, and further to 256 or the like; there has been provided a high density arrangement such as 300 dpi or 600 dpi in a unit of "dpi" indicating the number of discharge apertures per inch. The heating element (heater) acting as an electrothermal transducer disposed in these discharge apertures is driven by a high-frequency pulse on the order of several μsec to 10 μsec to form bubbles by film boiling, thereby implementing a high-rate, high-image-quality printing.

To achieve a high-definition color recording equivalent to silver halide photography, the size of dots must be reduced to the extent that the dots cannot be recognized (do not appear granular) on the printing paper. In this case, a setting is made such that the color ink droplet is approximately 5 pl (picoliter is a $10^{-12}$ liter), 40 to 50 μm in dot diameter, and 600×1200 to 1200×1200 dpi (dpi being a unit indicating the number of dots per inch). The above described atmosphere communication system printers are substantially compatible with such setting.

Means for electrically connecting the above described recording head and a recording apparatus is disposed in a carriage which allows the recording head mounted thereon to perform back and forth scanning. Specifically, the carriage is provided with a plurality of contacts, and when the recording head is attached to the carriage, a connection with a plurality of contacts provided in the recording head side is made, whereby an electrical connection between the recording head and the inkjet recording apparatus is achieved.

Japanese Patent Laid-Open No. 8-252909 (U.S. Pat. No. 5,828,386) discloses a recording head and a recording apparatus provided with a configuration for monitoring this electrical connection status. An AND circuit calculating a logical product between a recording signal supplied from the recording apparatus to an input terminal of the recording head, a clock signal for transferring the recording signal and a control signal for recording operation by the recording signal, and an output terminal for outputting the calculation result are provided in the recording head. Accordingly, it is possible to prevent recording failure such as recording dot dropouts, and damage etc. of recording head induced by the defective contact. Accordingly, such confirmation and/or monitoring of connection status becomes important, particularly in a recording head integrated with an ink tank and being detachable to an inkjet recording apparatus.

SUMMARY OF THE INVENTION

However, in the above described configuration calculating a logical product between a recording signal, clock signal and control signal, and outputting the result to thereby confirm the electrical connection status between the recording head and recording apparatus, noises are generated when an ordinary recording operation is performed. More specifically, when the heater is driven in an ordinary recording operation, respective signals for performing the subsequent recording operation are supplied to the recording head. Consequently, while the recording operation is performed, signals corresponding to the supplied clock signal and control signal may be outputted from the output terminal for outputting a connection status. These output signals may act as noises and affect data signals, thus causing recording defects.

A conventional connection status output circuit will be described with reference to FIGS. 2A to 2C. As shown in a circuit diagram of FIG. 2A, a recording signal DATA supplied from the recording apparatus, a clock signal CLK for transferring the recording signal, a drive signal HE for driving the heater, and a latch signal LT for latching the recording signal in a hold circuit are supplied. Then, a logical product between the recording signal and clock signal is calculated in an AND circuit 11, and a logical product between the drive signal and latch signal, in an AND circuit 12. A logical product between the outputs from the two AND circuits is calculated in an AND circuit 13, and the calculation result is outputted from a connection status output terminal H1126.

In a circuit for recording as shown in FIG. 1, the latch signal LT and drive signal HE being a control system signal are each a negative logic (low active) digital signal which is ON at a low level (Low). The reason for this is that negative logic is advantageous for noise margin. Also, when all the signals employ positive logic, if a short circuit or the like occurs, the latch signal is in the ON state at all times to drive the heater. Consequently, breaking of the heater may occur. From the reason described above, it is a general practice in the circuit design that, while the recording signal and clock signal employ positive logic, the control signals such as LT, HE employ negative logic.

Accordingly, when the signal is not present, i.e., when it is logically "false (0)", pulling-up to a high level is performed by a pull-up resistor; when it is logically "true (1)", a change to a low level is made. In contrast, recording signal DATA and clock signal CLK are positive logic (high active) digital signals which are ON at a high level, and connected to a pull-down resistor so that a change to a GND level is made when the signal is not present.

FIG. 2B is a timing chart showing the status of each signal supplied from the recording apparatus and the status of an output signal from the output signal CNO of the connection status output terminal H1126 when the connection status between the recording head and recording apparatus is confirmed. In the circuit of FIG. 2A, only when the latch signal, drive signal, recording signal and clock signal are all at a high level, the output signal CNO from the connection status output terminal H1126 is changed to a high level. Consequently, when each input signal at a high level is supplied from the recording apparatus at a given timing and the output signal CNO from the connection status output terminal H1126 is changed to a high level, the connection status between the recording head and recording apparatus is confirmed.

However, as described above, when a recording operation is actually executed, at the time when a plurality of electrothermal conversion elements disposed in the recording head are driven to discharge ink, also, similar signals are supplied to the recording head.

FIG. 2C is a timing chart showing the status of each signal received when the heater is actually driven, and the status of an output signal CNO from the connection status output terminal H1126 at that time. A recording signal DATA is supplied in synchronization with a clock signal CLK, and a latch signal is supplied to latch the supplied recording signal in a latch circuit. Afterward, when a drive signal HE is supplied, a selected heater is driven to discharge ink. The latch signal LT and drive signal HE are not present, i.e., at a high level, until the receiving of the recording signal DATA is completed. The recording signal DATA is synchronized with the clock signal CLK.

Consequently, the output signal CNO outputted from the connection status output terminal H1126 is a toggle signal designating the recording signal DATA and clock signal CLK. The output signal is outputted at approximately the same frequency as that of the clock signal, or at a frequency related to the clock signal, such as the clock signal frequency divided by an integer. Accordingly, acting as noises, the output signal may have adverse influence on the recording signal etc., causing recording failure.

The present invention has been achieved in view of the above-mentioned circumstances, and has an object to prevent from having adverse influence when recording is actually performed by a signal outputted from a circuit for confirming the connection status.

To achieve the above object, a recording head according to one aspect of the present invention is detachable to a recording apparatus and comprises: connecting terminals corresponding respectively to recording signal, clock signal for transferring the recording signal and control signal for controlling a recording operation according to the recording signal, the signals being supplied from the recording apparatus; and a connection status output circuit for performing a logical operation between the signals supplied to the connecting terminals, and outputting a signal designating the connection status, wherein the connection status output circuit is configured such that, when the connection status is confirmed, the signal designating the connection status is outputted, and when a recording operation is performed, the output signal does not change.

When performed in this manner, the output of the connection status output circuit for confirming the connection status between the recording apparatus and recording head does not change at a frequency related to the clock signal when recording is actually performed.

Consequently, the circuit for confirming the connection status between the recording head and recording apparatus is prevented from having adverse influence on other signals (particularly, on the recording signal) when recording is actually performed.

The control signal may include at least one of a latch signal for fixing the recording signal supplied and a drive signal for allowing a recording operation according to the recording signal to be executed.

The recording signal and the clock signal may be a positive logic digital signal, and the control signal may be a negative logic digital signal.

The connection status output circuit may have an AND circuit calculating a logical product between signals supplied to the circuit, and one of the supplied signals, or other signals excluding one of the supplied signals may be an inverted signal.

In this case, the control signal may include a plurality of signals, and the connection status output circuit may include: a first AND circuit calculating a logical product between the recording signal and the clock signal; a second AND circuit calculating a logical product between the plurality of signals; a third AND circuit calculating a logical product between outputs of the first and second AND circuits; and an inverter inverting any one of the plurality of signals before being supplied to the second AND circuit.

When the above recording head is one including a recording element for discharging liquid, the above object is also achieved by a head cartridge including the recording head and a tank for supplying liquid to the recording head, and a recording apparatus performing recording on a recording medium by use of the above recording head.

According to the present invention, when the electrothermal conversion element is driven to perform recording, a signal of a non-signal state is outputted from the output terminal for outputting the connection status. Therefore, noises having adverse influence on the recording signal are not generated, thus allowing implementing an accurate recording operation.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
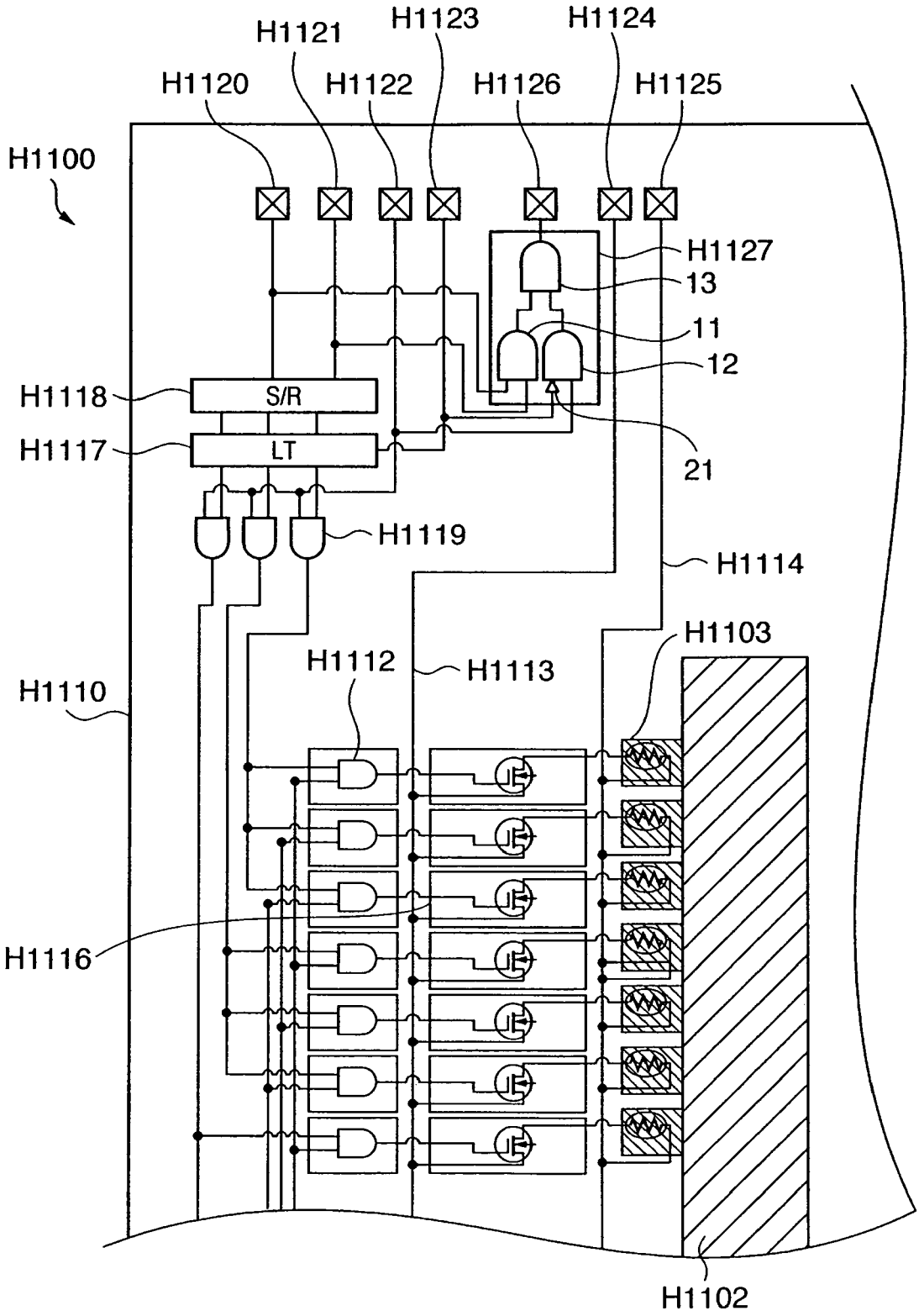
FIG. 1 is a view showing a circuit configuration having a recording head formed on a recording element substrate according to First Embodiment of the present invention.
Figure 2A:
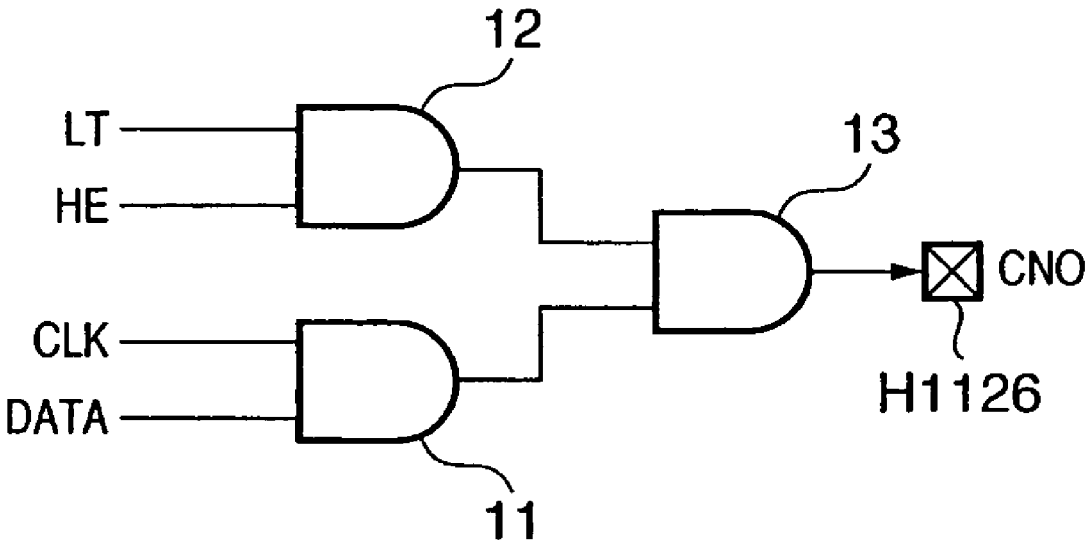
FIG. 2A is a circuit diagram showing the configuration of a conventional connection status output circuit.
Figure 2B:
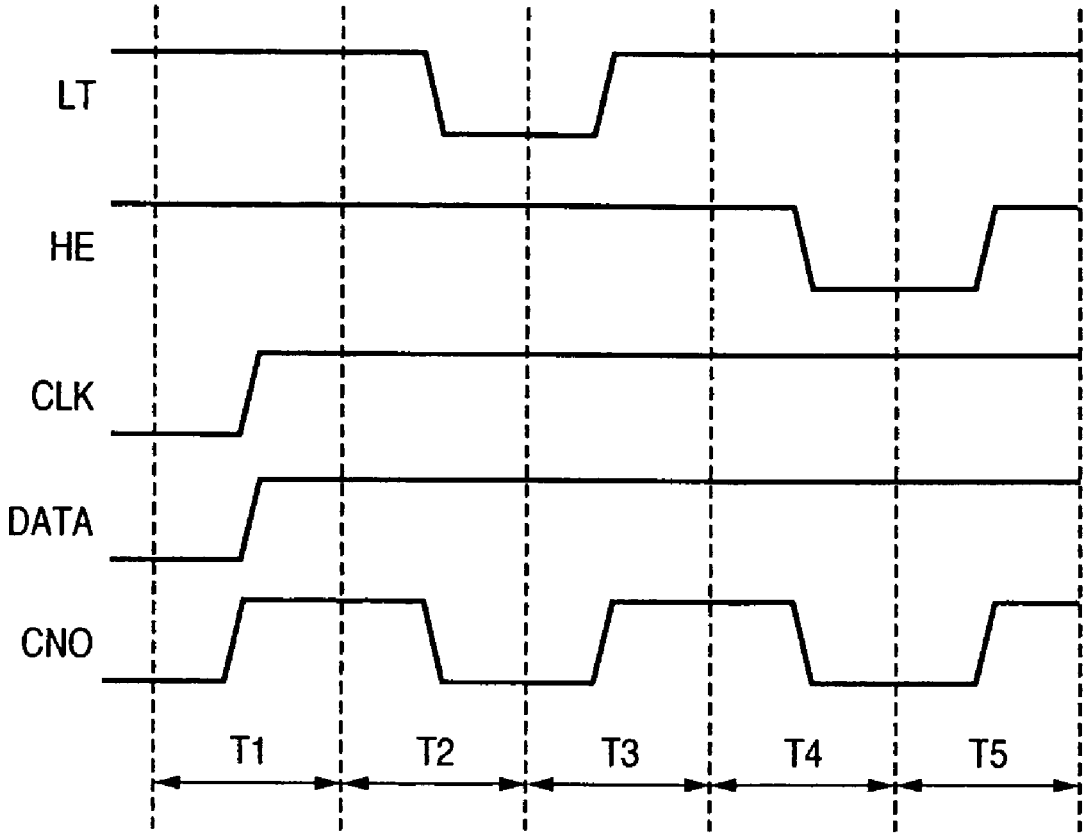
FIG. 2B is a timing chart showing the status of signals when the connection status is confirmed in the connection status output circuit of FIG. 2A.
Figure 2C:
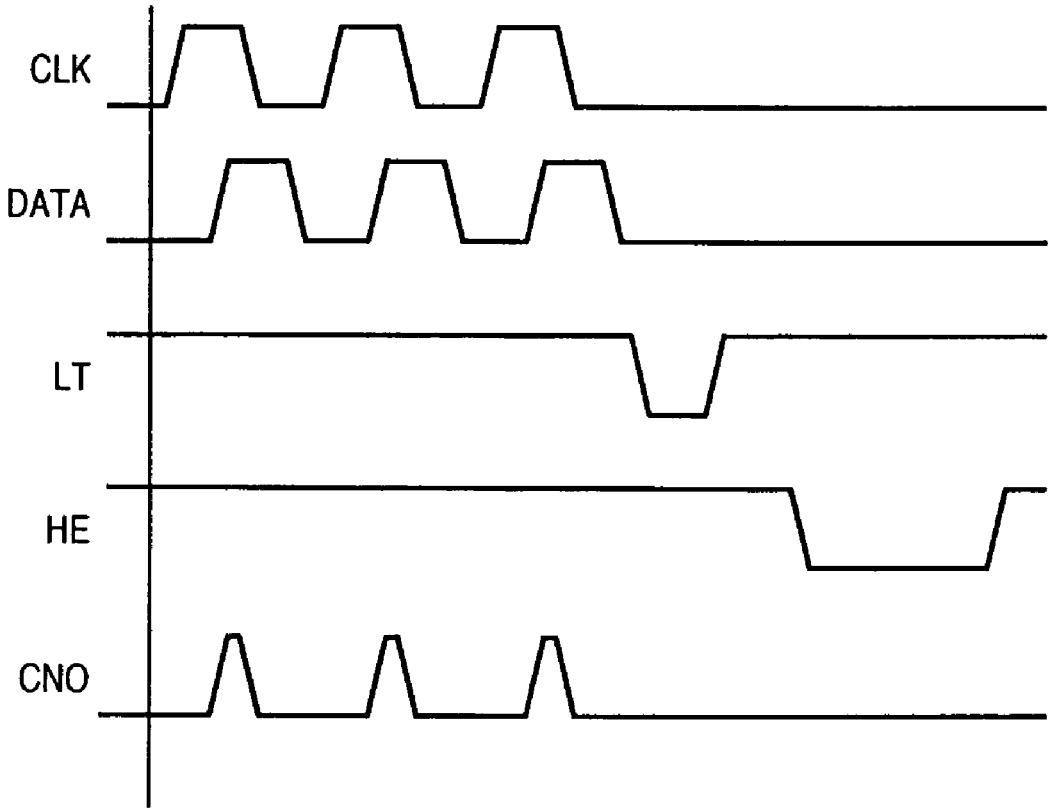
FIG. 2C is a timing chart showing the status of signals when a recording operation is actually executed in the connection status output circuit of FIG. 2A.

Preferred embodiments of the present invention will be exemplarily described below in detail with reference to the attached drawings. Constituent elements described in embodiments described below are merely exemplary of the present invention, and are not be construed to limit the scope of the present invention.

In this specification, the term "recording" (also referred to as "print") does not mean only a case where significant information, such as character and figure, is formed, but is to be broadly construed. More specifically, the term also means, in a broader sense, a case where images, designs, patterns or the like are formed on a recording medium, or a case where the medium is processed, irrespective of whether or not it is significant, and irrespective of whether or not visualization is performed for humans to be able to perceive it by eye.

Also, the term "recording medium" means not only a paper sheet used in a typical recording apparatus, but also in a boarder sense, a material capable of accepting ink, such as cloth, plastic film, metal plate, glass, ceramics, wood or leather.

Further, the term "ink" or "liquid" is to be broadly construed similarly to the above definition of the term "recording (printing)". More specifically, the term means a liquid which is applied onto a recording medium and thereby capable of being used for formation of images, designs, patterns or the like, or for processing of a printing medium, or for processing of ink (for example, solidification or insolubilization of a coloring material contained in an ink applied to a recording medium).

The term "recording element substrate" used below indicates not a mere substrate composed of a silicon semiconductor but a configuration having disposed therein each element, wiring and the like.

Further, the term "on the substrate" indicates not only its literal meaning but also the surface of element substrate and the interior portion side of element substrate in the vicinity of the surface thereof. Also, the term "arrange" used in the present invention indicates not placing each separate element separately on the surface of substrate but forming integrally and fabricating each element on the element substrate by a semiconductor circuit fabrication process etc.

Further, in this specification, signals supplied to a connection status output circuit from a recording signal input terminal, a clock signal input terminal, a latch signal input terminal and a drive signal input terminal are referred to as a recording signal DATA, a clock signal CLK, a latch signal LT and drive signal HE.

First, the mechanical configuration of a recording head according to the present invention and an inkjet recording apparatus performing recording by use of the recording head will be roughly described.

(Recording Head)

FIGS. 6A to 8 are explanatory views for explaining a preferred recording head in which the present invention is implemented or applied. Each constituent element will be described below with reference to these drawings.

Figure 6B:
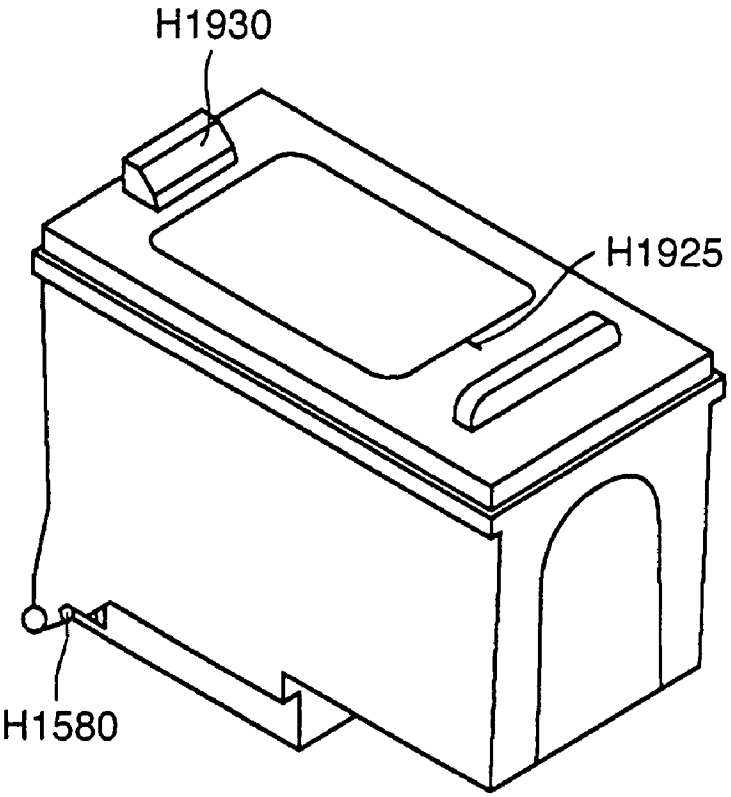
FIG. 6B is a perspective view showing the external appearance of the recording head.
Figure 6A:
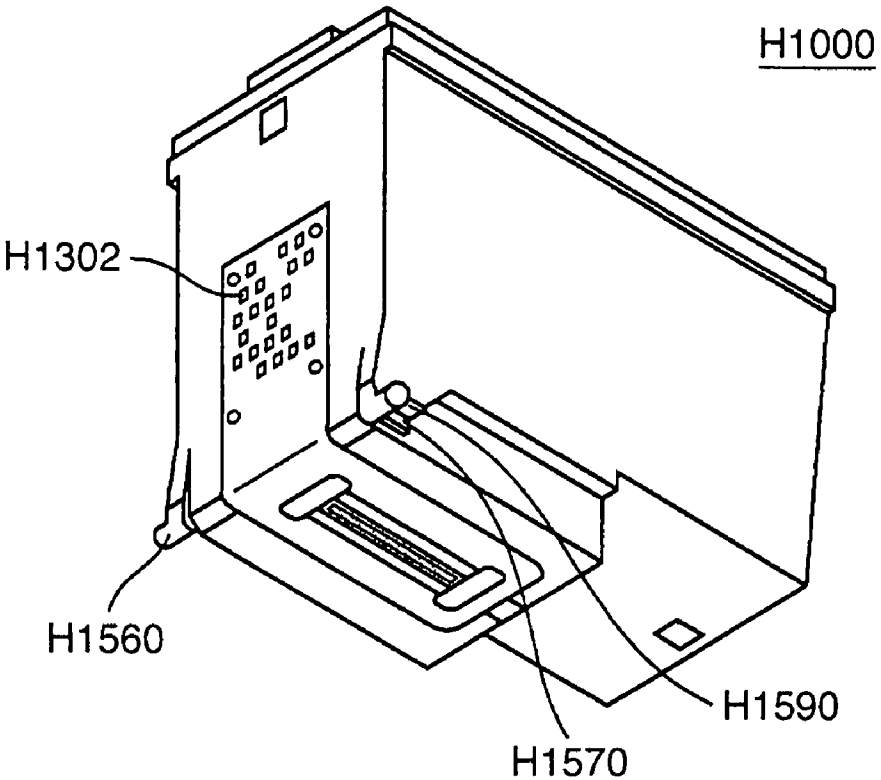
FIG. 6A is a perspective view showing the external appearance of the recording head.

The recording head according to the present embodiment has an ink tank-integrated type configuration. There are two types of recording heads: a first recording head H1000 filled with black ink as shown in FIGS. 6A and 6B and a second recording head H1001 filled with color inks (cyan ink, magenta ink and yellow ink) not shown in FIGS. 6A and 6B. These two recording heads H1000 and H1001 are secured and supported on a carriage mounted in the inkjet recording apparatus by positioning means and electric contacts, and at the same time detachable to the carriage. When the filled ink is no longer consumed, the recording head can be replaced.

Regarding these recording heads H1000 and H1001, each constituent element constituting the recording head will be described below in detail.

The first recording head H1000 and the second recording head H1001 are each a recording head of the bubble jet (registered mark) type using an electrothermal transducer which generates thermal energy for allowing film boiling to be generated in the ink according to an electrical signal. More specifically, they are a so-called sideshooter-type recording head in which an electrothermal transducer and an ink discharge aperture are arranged opposite each other.

Only the first recording head H1000 will be described below. The second recording head H1001 for discharging inks of a plurality of colors, such as cyan. magenta and yellow, also has the same basic configuration as that of the first recording head H1000, and hence an explanation thereof is omitted.

Figure 7:
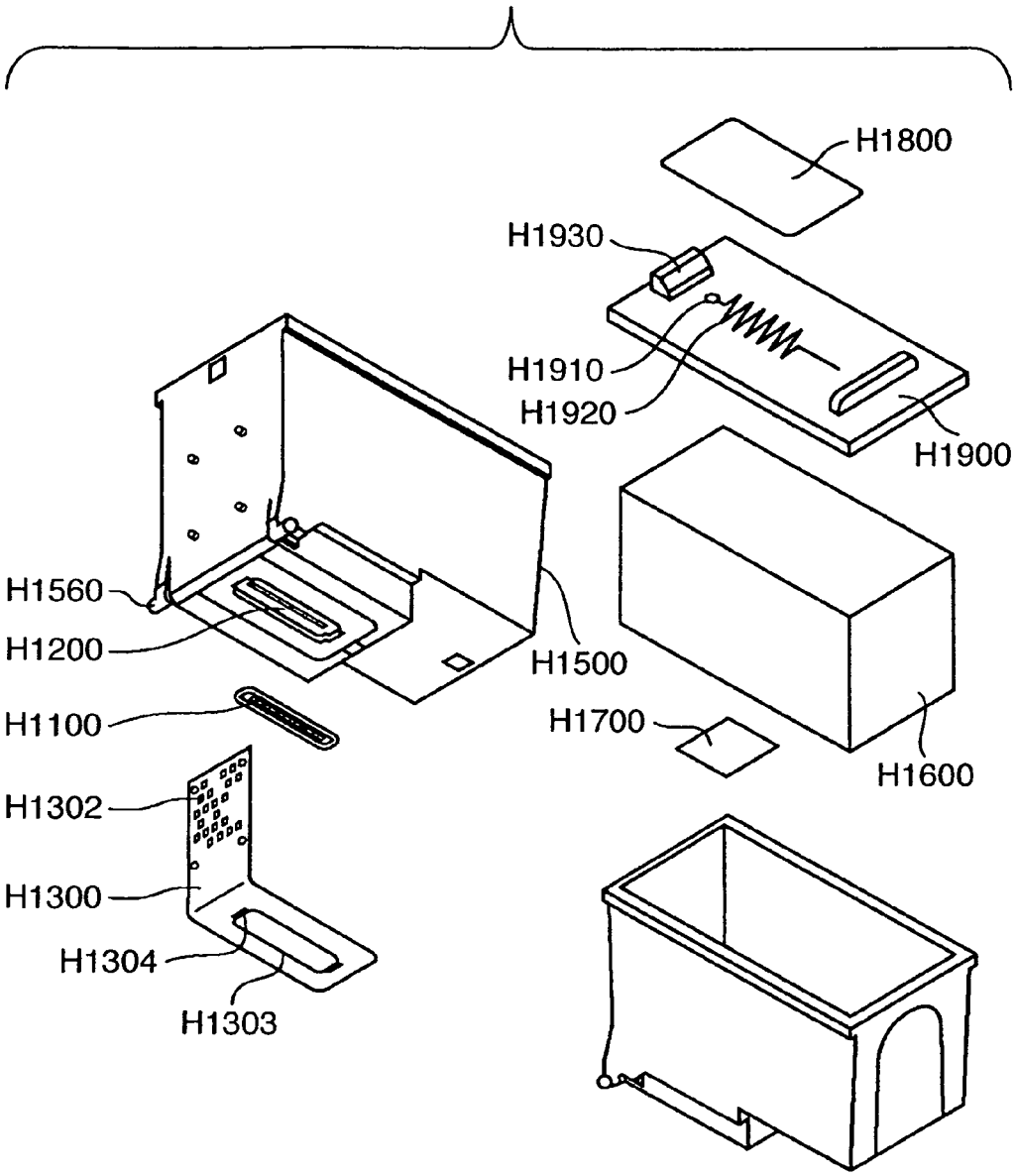
FIG. 7 is a broken perspective view showing the configuration of the recording head.

FIG. 7 is an exploded perspective diagram of the first recording head H1000. The first recording head H1000 is constituted of a recording element substrate H1100, an electric wiring tape H1300, an ink supply holding member H1500, a filter H1700, an ink absorbing material H1600, a lid member H1900 and a seal member H1800.

(Recording Element Substrate H1100)

Figure 8:
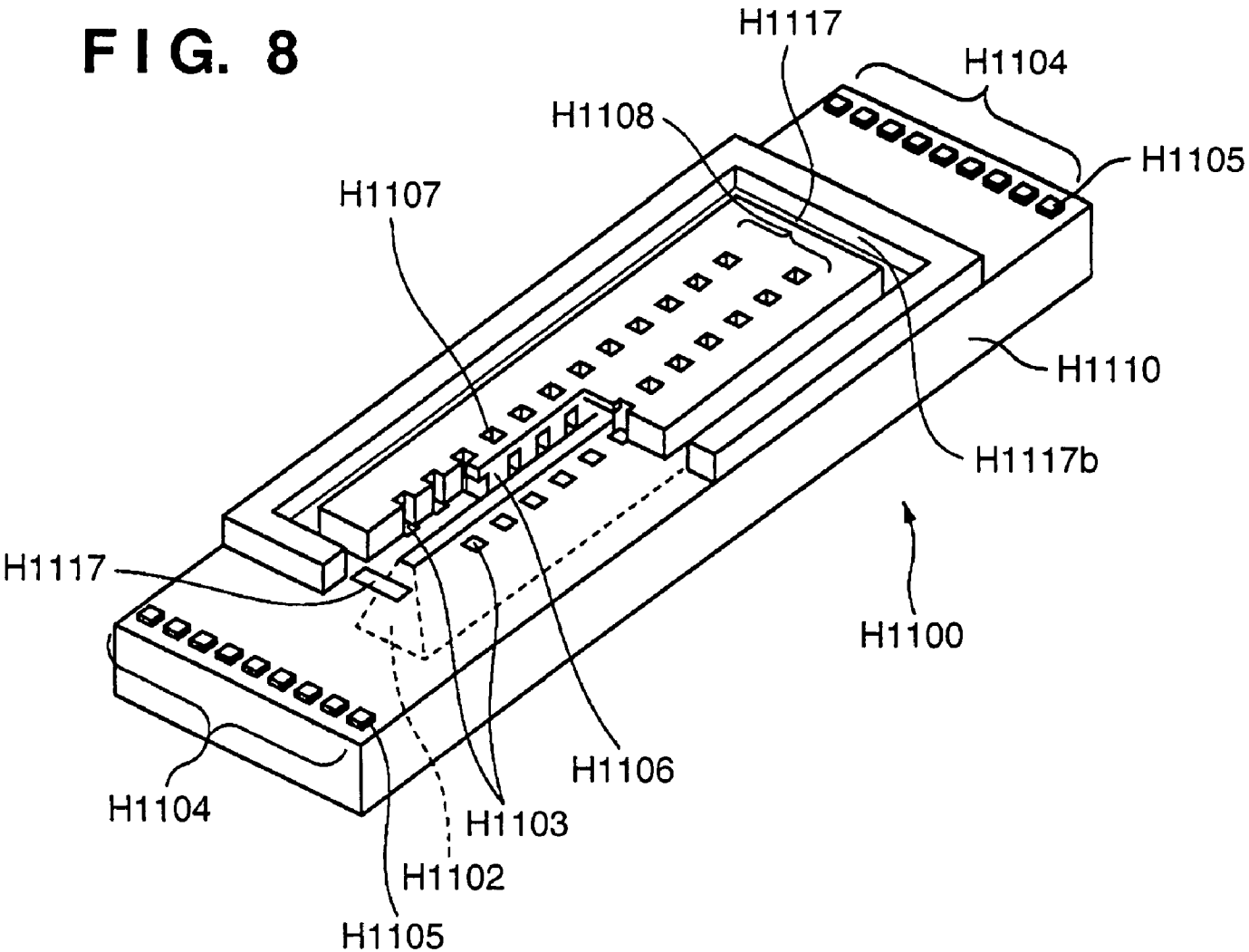
FIG. 8 is an external perspective view of a recording element substrate of recording head.

FIG. 8 is a view for explaining the configuration of the recording element substrate H1100, being a partly broken perspective view. The recording element substrate H1160 is constituted, for example, by forming an ink supply aperture H1102 having a longitudinal groove-shaped through aperture acting as an ink flow path on a Si substrate H1110 being 0.5 mm to 1 mm in thickness by using a method such as anisotropic etching or sandblast using Si crystal orientation.

On the Si substrate H1110, electrothermal conversion elements H1103 are arranged row by row on both sides of the ink supply aperture H1102, the ink supply aperture H1102 being sandwiched between the electrothermal conversion elements H1103. Further, there is formed electric wiring (not shown) made of Al or the like for supplying electric power to the electrothermal conversion elements H1103. These electrothermal conversion elements H1103 and the electric wiring can be formed by using a known film formation technique. The electrothermal conversion elements H1103 of each row are mutually aligned in a zigzag manner. More specifically, the discharge apertures of each row are arranged so that the positions thereof are slightly out of alignment with each other in a direction orthogonal to each row.

Also, on the Si substrate H1110, an electrode section H1104 for supplying electric power to the electric wiring and supplying an electrical signal for driving the electrothermal conversion elements H1103 are aligned along the edge parts in the sides positioned in both ends of the row of the electrothermal conversion elements H1103. On the electrode section H1104, there are formed bumps H1105 made of Au or the like.

On the Si substrate H1110, on the surface on which patterns of wiring and storage elements, such as a resistor element, are formed, a structure, made of a plastic material, including an ink flow path for each electrothermal conversion element H1103 is formed by a photolithographic technique. The structure has an ink flow path wall H1106 for partitioning each ink flow path and a top section covering the upper part thereof; discharge apertures H1107 are opened in the top section. The discharge apertures H1107 are disposed opposite the respective electrothermal conversion elements H1103, whereby a discharge aperture group H1108 is formed.

In the recording element H1100 having the configuration described above, ink supplied from the ink flow path H1102 is discharged from the discharge apertures H1107 positioned opposite each electrothermal conversion element H1103 by bubble pressure generated by heating each electrothermal conversion element H1103.

(Electric Wiring Tape H1300)

As shown in FIG. 7, the electric wiring tape H1300 constitutes an electrical signal path for applying an electrical signal for discharging ink toward the recording element substrate H1100, and is constituted by forming a wiring pattern of copper foil on a base substrate of polyimide. Also, an opening H1303 for incorporating the recording element substrate H1100 is formed. In the vicinity of the edges of this opening H1303, there are formed electrode terminals H1304 connected to the electrode section H1104 of the recording element substrate H1100. Further, in the electric wiring tape H1300, there is formed external signal input terminals H1302 for receiving electrical signals from the main body apparatus. The external signal input terminals H1302 and the electrode terminals H1304 are directly connected by the wiring pattern of copper foil.

The electrical connection between the electric wiring tape H1300 and the recording element substrate H1100 is made by pressure bonding or the like. For example, the bumps H1105 formed in the electrode section H1104 of the recording element substrate H1100 and the electrode terminals H1304 of the electric wiring tape H1300 corresponding to the electrode section H1104 of the recording element substrate H1100 are electrically coupled by a thermal supersonic pressure bonding technique.

Also, the rear face of part of the electric wiring tape H1300 is glued to the flat surface around the joining surface of the recording element substrate H1100 by a second adhesive. The electrical connection part between the recording element substrate H1100 and electric wiring tape H1300 is sealed by a first sealant and a second sealant, whereby the electrical connection part is protected against corrosion by ink and external shock. The first sealant is used to seal: the rear face side of a connection part between the electrode terminals H1304 of the electric wiring tape H1300 and the bumps H1105 of the first recording element substrate H1100; and the circumferential part of the first recording element substrate H1100. Meanwhile, the second sealant is used to seal the obverse side of the above connection part.

As shown in FIG. 7, the first recording head H1000 and the second recording head H1001 (not shown) each include the following members: a mount guide H1560 for performing guiding to a carriage mounting position of the inkjet recording apparatus; an engaging section H1930 for performing mounting and fixing on the carriage by a head set lever; an abutting portion H1570 for X direction (carriage scan direction) for performing positioning on a predetermined mounting position of the carriage; an abutting portion H1580 for Y direction (recording medium conveying direction); an abutting portion H1590 for Z direction (ink discharge direction). When positioning is performed by these abutting portions, electric contact can be correctly made between the external signal input terminals H1302 on the electric wiring tapes H1300 and H1301 and the contact pins of the electric contact section disposed within the carriage.

(Inkjet Recording Apparatus)

Figure 9:
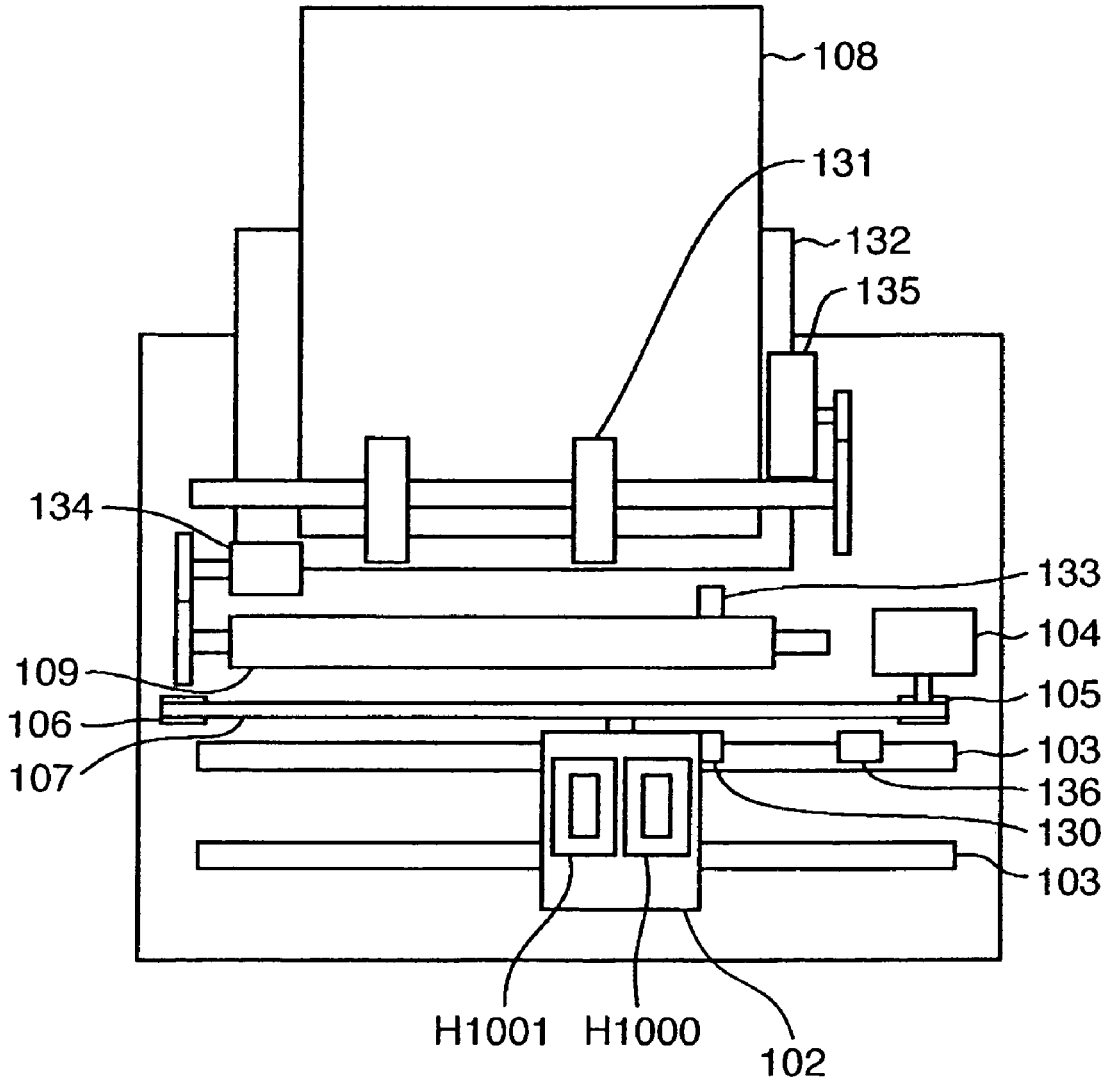
FIG. 9 is a view showing an exemplary recording apparatus on which the recording head according to the present invention can be mounted.

A liquid discharge-type recording apparatus, on which the above described cartridge-type recording head can be mounted, will be described. FIG. 9 is an explanatory view showing an exemplary recording apparatus on which a recording head according to the present invention can be mounted.

Referring to FIG. 9, the recording apparatus has a carriage 102 on which the recording head H1000 shown in FIGS. 6A to 8 and the second recording head H1100 (not shown in FIGS. 6A to 8) are positioned and mounted in a replaceable manner. In the carriage 102, there is provided an electrical connection section for transmitting a drive signal etc. to each discharge section via the external signal input terminals on the recording head.

The carriage 102 is supported so as to be able to scan back and forth along a guide shaft 103, disposed in the apparatus body, extending in a main scanning direction. The control of position and movement of the carriage 102 as well as the drive thereof are performed by a main scanning motor 104 via driving mechanisms, such as a motor pulley 105, a follower pulley 106, and a timing belt 107, and at the same time, the position and movement thereof is controlled. Also, a home position sensor 130 is provided in the carriage 102. When the home position sensor 130 on the carriage 102 moves past the position of a shield board 136, a position acting as the home position is detected.

As for a recording medium 108 such as a recording paper or a plastic thin sheet, when a paper feeding motor 135 rotates a pickup roller 131 via a gear, the recording medium 108 is separated and fed one by one from an auto sheet feeder 132. Further, when a conveying roller 109 rotates, the recording medium 108 is made to move past a position in a printing section opposite the discharge aperture face of the recording head, whereby the recording medium 108 is conveyed or sub-scanned. Driving by a conveying motor 134 is transmitted to the conveying roller 109 via a gear. The determination of whether or not feeding has been performed, and the confirming of a cue position when feeding is performed are performed at the time when the recording medium 108 moves past a paper end sensor 133. This paper end sensor 133 is also used to detect where the rear end of the recording medium 108 is actually positioned and to finally determine the current recording position from the actual rear end.

The rear face of the recording medium 108 is supported by a platen (not shown) so as to form a flat printing surface in the printing section. In this case, the recording heads mounted on the carriage 102 are held so that the discharge aperture faces thereof protrude downward from the carriage 102 and are made parallel to the recording medium 108 between two sets of conveying rollers.

The recording heads H1000 and H1001 are mounted on the carriage 102 so that the alignment direction of discharge apertures in each discharge aperture section intersects with the scanning direction of the carriage 102. Liquid is discharged from these discharge aperture rows to perform recording.

Also, by using as a replacement, a recording head having the same configuration as that of the second recording head and using the internal ink constituted of light magenta, light cyan and black, the usage as a high-picture quality photo printer is also possible.

(Circuit Configuration of Recording Head)

The circuit configuration of the recording head according to the present invention, and the connection status output circuit for confirming the connection status with the recording apparatus will be described by taking as an example several embodiments.

First Embodiment

FIG. 1 is a view showing a circuit configuration formed in a recording element substrate H1100 of a recording head H1000 according to First Embodiment. In the recording element substrate H1100, semiconductor elements and wirings are formed on a Si substrate H1100 by a semiconductor process. In the recording head H1100 according to the present embodiment, an ink supplying aperture H1102 is provided with n of nozzles per row. Corresponding to each of these nozzles, an electrothermal conversion element H1103 and a drive element (a driver transistor) H1116 driving the electrothermal conversion element H1103 are provided. The electrothermal conversion element H1103, drive element H1116 and nozzles are collectively referred to as a recording element.

In the recording element substrate H1100, as the electric contacts with the recording apparatus, there are provided respective input terminals for receiving four signals such as recording signal DATA, clock signal CLK, and latch signal LT and drive signal HE, each acting as a control signal. That is, a recording signal input terminal H1121, a clock signal input terminal H1120, a latch signal input terminal H1123 and a drive signal input terminal H1122 are provided. Also, the recording head of FIG. 1 employs split drive in which n of the recording elements are divided into a plurality of blocks to be driven.

Further, reference character H1127 denotes a connection status output circuit, H1126 denotes an output terminal of the connection status output circuit, H1124 denotes a drive voltage input terminal for supplying a drive voltage to a drive voltage line H1113, and H1125 denotes a GND terminal connected to a GND line H1114. Reference character H1118 denotes a shift register sequentially shifting a recording signal according to a clock signal, H1117 denotes a latch circuit holding the status of an output signal from the shift register, and H1119 and H1112 each denote a logical circuit selecting a drive element to be driven. The connecting terminals indicated by reference characters H1120 to H1125 constitute the electrode section H1104 shown in FIG. 8.

The drive of this recording signal is performed by the following procedure.

In synchronization with a clock signal received from the clock signal input terminal H1120, a recording signal is received from the recording signal input terminal H1121. The received recording signal is sequentially held in the shift register H1118. In this manner, the predetermined bits of recording signal are supplied and held in the shift register H1118. Then, a latch signal is supplied to the latch signal input terminal H1123. The latch circuit H1117 at the subsequent stage of the shift register H1118 latches the recording signal held in the shift register at the timing of receiving the latch signal. Also, part of the recording signal is supplied to a decoder (not shown) as a block selection signal BLE for dividing and driving the n of electrothermal conversion elements H1103. Among the recording elements selected by the block selection signal, a recording element selected by an output from an AND circuit H1119 calculating a logical product between a drive signal supplied to the drive signal input terminal H1122 and a recording signal outputted from the latch circuit H1117, is driven. Ink is discharged from the nozzles of the driven recording element, whereby a recording operation is performed.

A procedure according to the present embodiment for confirming the electrical connection status between the recording head H1000 and the recording apparatus will be described.

As shown in FIG. 9, the recording head H1000 is mounted on the carriage 102 of the recording apparatus. In the carriage 102, there is provided a contact section (not shown) having electric contacts for connecting with the electrode section H1104 of the recording head H1000. Consequently, when the recording head H1000 is mounted on the carriage 1302, the electric contacts of the carriage make contact with the electrode section H1104, disposed in the recording head H1000, for sending and receiving various electrical signals, whereby an electrical connection is made.

According to the present embodiment, as means for confirming the electrical connection status with the recording apparatus, a connection status output circuit H1127 is provided in the recording head H1000. An output signal of the connection status output circuit is outputted to the recording apparatus via the connection status output terminal H1126.

Figure 3A:
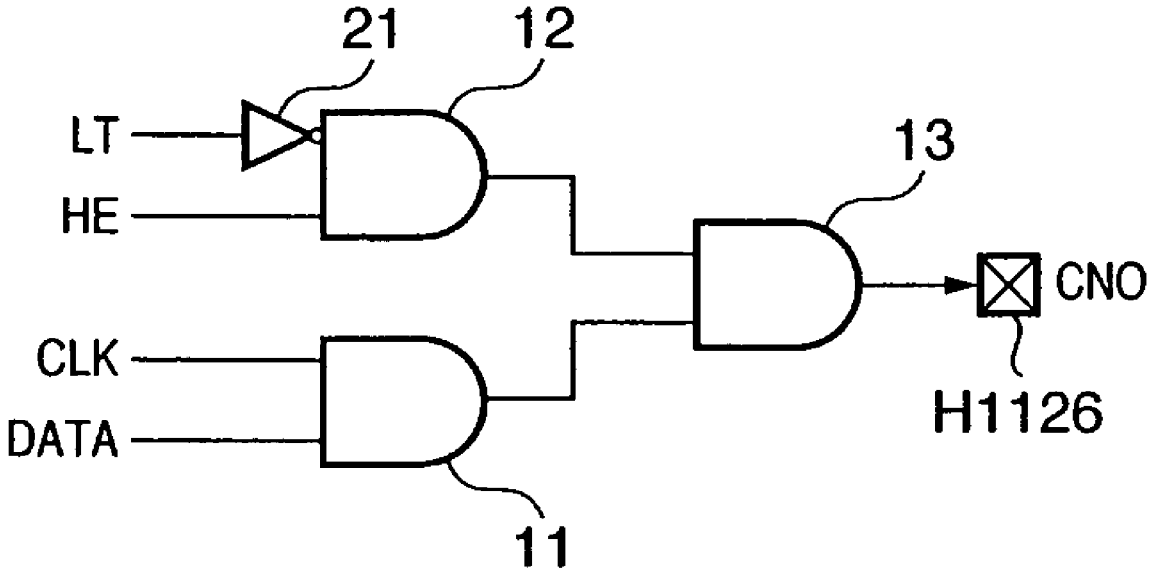
FIG. 3A is a view showing the configuration of a connection status output circuit according to First Embodiment.

FIG. 3A is a circuit diagram showing in detail the connection status output circuit H1127. The connection status output circuit H1127 according to the present embodiment has three AND circuits. A first AND circuit 11 calculates a logical product between recording signal DATA and clock signal CLK. A second AND circuit 12 calculates a logical product between latch signal LT and drive signal HE. A third AND circuit 13 calculates a logical product between the calculation results of the first AND circuit 11 and second AND circuit 12. Here, the latch signal LT is inverted by an inverter 21 before being supplied to the second AND circuit 12. An output from the third AND circuit 13 is outputted to the recording apparatus via the connection status output terminal H1126.

Figure 3B:
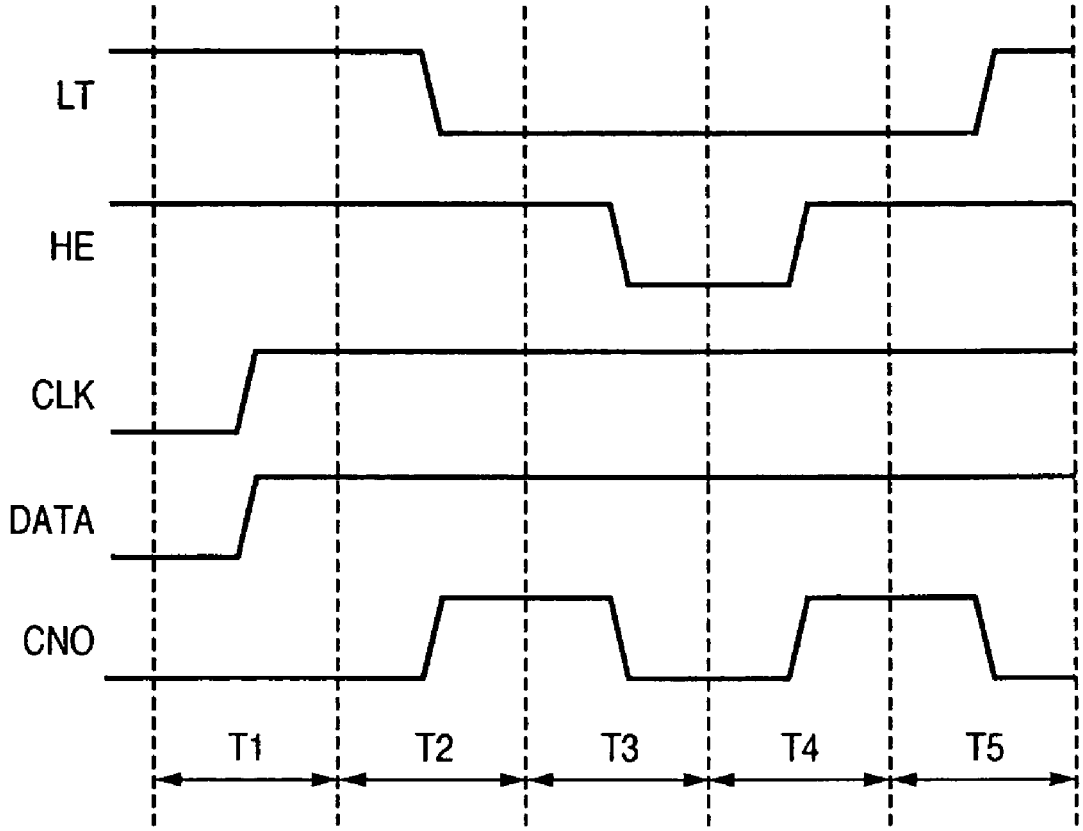
FIG. 3B is a timing chart showing the status of signals when the connection status is confirmed in the connection status output circuit of FIG. 3A.

FIG. 3B is a timing chart showing the status of each signal supplied from the recording apparatus to the recording head and the status of an output signal outputted from the connection status output terminal H1126 when confirming the connection status between the recording head and recording apparatus.

Here, the latch signal LT and drive signal HE being a control system signal are each a negative logic (low active) drive signal which is ON at a low level. In the negative logic, when the signal is not present, i.e., when it is logically "false (0)", pulling-up to a high level is performed by a pull-up resistor; when it is logically "true (1)", a change to a low level is made. The reason for this operation is that, before using CMOS as a semiconductor element, a configuration constituted of a TTL circuit has been used, but when the TTL circuit is driven at 5 V, the range which is recognized as a low level by the TTL circuit is narrow. Specifically, a range of 5 to 3 V corresponded to a high level; a range of 0 to 0.8 V corresponded to a low level.

In contrast, recording signal DATA and clock signal CLK are a positive logic (high active) digital signal which is ON at a high level, and connected to a pull-down resistor so that a change to a GND level is made when the signal is not present. The reason for this is that, if all the signals employ positive logic, when a short circuit of the signal system or an interruption of the power system occurs to change all the signals to a high level, then the drive control of the recording elements becomes impossible. According to the present embodiment, to prevent such status from occurring, signals of different logic are used; since it is usually advantageous in noise margin, the latch signal and drive signal being a control system signal employ negative logic, and the clock signal and recording signal employ positive logic.

Also, according to the present embodiment, the output CNO outputted from the connection status output terminal H1126 is a positive logic (high active) digital signal which is ON at a high level, and connected to a pull-down resistor so that a change to a GND level is made when the signal is not present.

In FIG. 3B, at first, in a first period T1, recording signal DATA, clock signal CLK, latch signal LT and drive signal HE sent from the recording apparatus to the recording head are all changed to a high level. Among these, the recording signal DATA and clock signal CLK are made to maintain its high level until a fifth period T5. Second, in a second period T2, the latch signal LT is changed to a low level. In this status, when a high-level signal is outputted from the output terminal H1126, the electrical connection between the recording signal input terminal H1121, clock signal input terminal H1120 and latch signal input terminal H1123, and the recording apparatus is confirmed. The latch signal LT is made to maintain its low level until a fourth period T4. Afterward, in a third period T3, the drive signal HE is changed to a low level. In this status, when the status of the output signal CNO is changed from the high level to a low level, the electrical connection between the drive signal input terminal H1122 and the recording apparatus is also confirmed. Afterward, in the fourth period T4, the drive signal HE is returned to the high level, and in the fifth period T5, the latch signal LT is returned to the high level, whereby the connection status confirming processing is completed.

In this manner, it is determined that the electrical connection between the recording head H1000 and the recording apparatus is normal. By performing this connection status confirming processing at the time of turning on the recording apparatus, or before starting a recording operation at the time of standby, it is possible to prevent recording failure such as recording dot dropouts, or damage etc. of recording head induced by the defective contact.

The processing of confirming the electrical connection status between the recording head and the recording apparatus by the connection status output circuit H1127 was described above. However, as described above, when a recording operation is actually executed, also, signals are supplied to these input terminals. The operation of the connection status output circuit H1127 and the signal outputted from the connection status output terminal H1126 when a recording operation is actually executed, will be studied below.

Figure 3C:
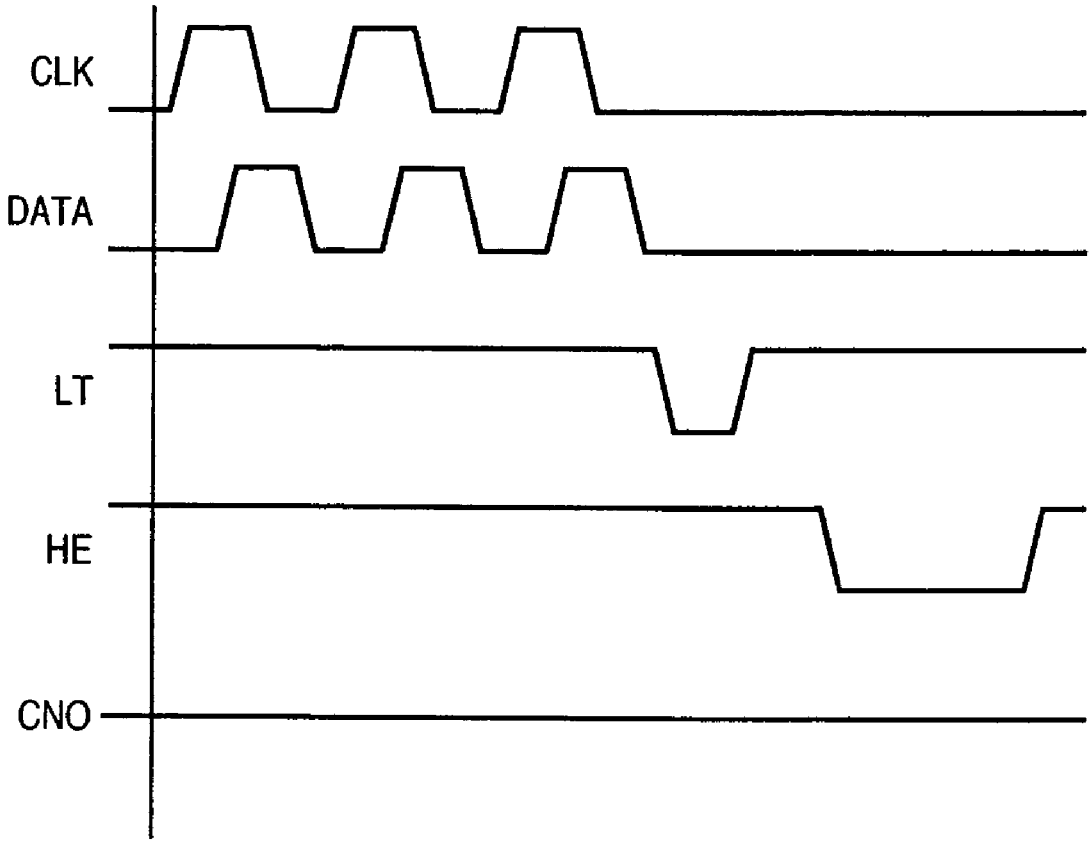
FIG. 3C is a timing chart showing the status of signals when a recording operation is actually executed in the connection status output circuit of FIG. 3A.

FIG. 3C is a timing chart showing the status of each signal when a recording operation according to the present embodiment is actually executed. A clock signal CLK of a predetermined frequency is supplied, and in synchronization with this signal, a recording signal DATA is supplied to the shift register. Then, when each data of the recording signal is held in the shift register, the latch signal LT is changed to a low level to latch the recording signal to the latch circuit disposed at the rear stage of the shift register. Afterward, when the drive signal HE is changed to a low level, a selected recording element is driven to discharge ink.

Here, while the latch signal LT is at the low level, the status of the shift register must be maintained. Therefore, a recording signal DATA is not supplied from the recording apparatus to the recording head. Also, according to the present embodiment, control is performed such that, while the drive signal HE is active (at a low level), the recording apparatus does not output the subsequent recording signal DATA.

In the connection status output circuit H1127 according to the present embodiment, when recording signal DATA, clock signal CLK and drive signal HE are changed to a high level, and at the same time, the latch signal LT is changed to a low level, then output signal CNO is changed to "true (1)". However, as described above, while the latch signal LT is at a low level, the recording signal DATA is not supplied from the recording apparatus to the recording head. Consequently, when a recording operation is actually executed, the output signal CNO from the connection status output circuit H1127 is never changed to "true (1)", and the output signal CNO from the connection status output terminal H1126 is at GND level (no signal) at all times.

As described above, according to the present embodiment, when a recording operation is executed, the signal outputted from the connection status output terminal H1126 is at GND level at all times. Thus, noises affecting other signals, particularly recording signal don't occur. Accordingly, the circuit for confirming the connection status between the recording head and the recording apparatus is prevented from having adverse effect on other signals (particularly, recording signal) when recording is actually performed.

Second Embodiment

Second Embodiment of a connection status output circuit according to a recording head of the present invention will be described below. In the following description, an explanation of parts corresponding to First Embodiment described above is omitted, and characteristic parts of the present embodiment are mainly described.

Figure 4A:
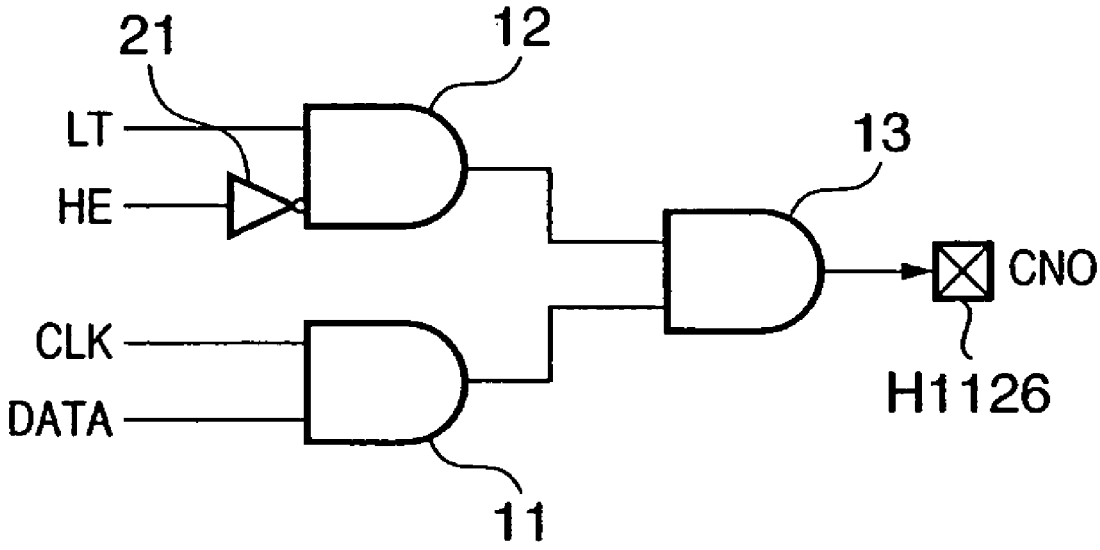
FIG. 4A is a view showing the configuration of a connection status output circuit according to Second Embodiment.

FIG. 4A is a circuit diagram showing the configuration of a connection status output circuit H1127 according to the present embodiment. Similarly to First Embodiment, the connection status output circuit of the present embodiment also receives recording signal DATA, clock signal CLK, latch signal LT and drive signal HE. A first AND circuit 11 calculates a logical product between the recording signal DATA and clock signal CLK. A second AND circuit 12 calculates a logical product between the latch signal LT and drive signal HE. A third AND circuit 13 calculates a logical product between the calculation results of the first AND circuit 11 and second AND circuit 12. Here, according to the present embodiment, the latch signal LT is inverted by an inverter 21 before being supplied to the second AND circuit 12. An output from the third AND circuit 13 is outputted to the recording apparatus via the connection status output terminal H1126.

Figure 4B:
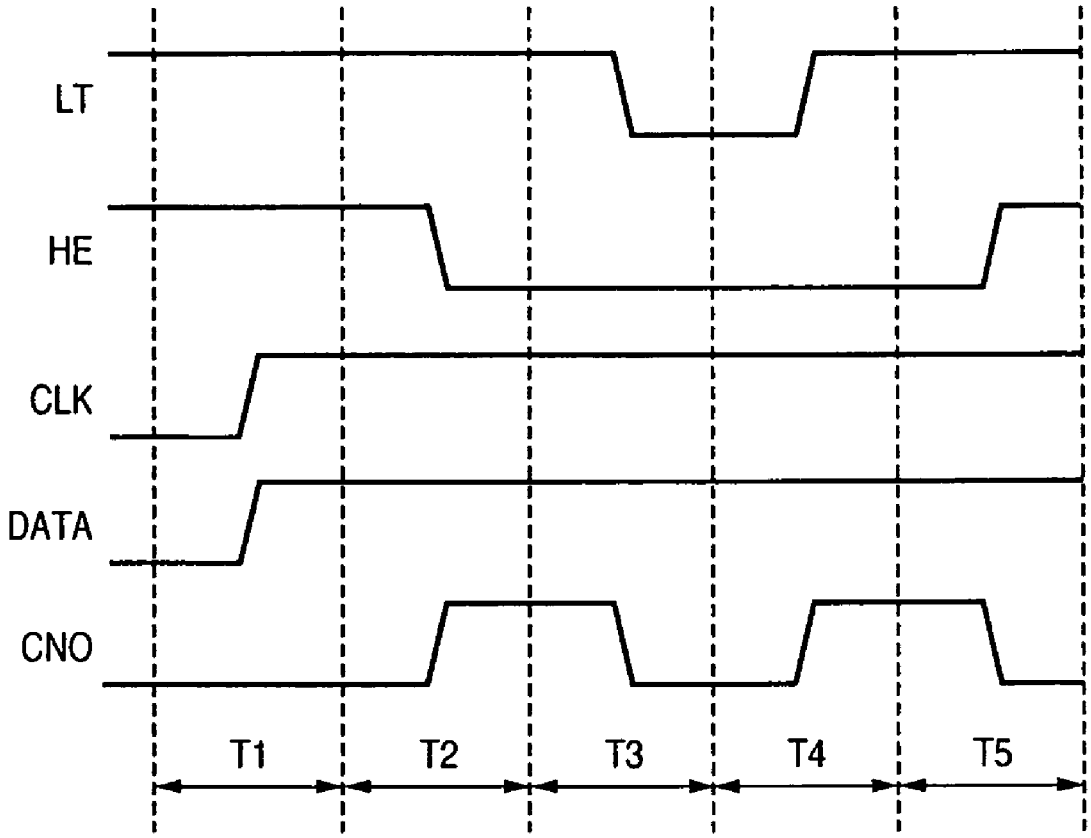
FIG. 4B is a timing chart showing the status of signals when the connection status is confirmed in the connection status output circuit of FIG. 4A.

FIG. 4B is a timing chart showing the status of each signal supplied from the recording apparatus to the recording head and the status of an output signal CNO outputted from the connection status output terminal H1126 when confirming the connection status between the recording head and recording apparatus according to the present embodiment.

According to the present embodiment, also, similarly to First Embodiment, latch signal LT and drive signal HE being a control system signal are a negative logic (low active) digital signal which is ON at a low level. Also, recording signal DATA and clock signal CLK are a positive logic (high active) digital signal which is ON at a high level.

First, in a first period T1, recording signal DATA, clock signal CLK, latch signal LT and drive signal HE sent from the recording apparatus to the recording head are all changed to a high level. Among these, the recording signal DATA and clock signal CLK are made to maintain its high level until a fifth period T5. Subsequently, in a second period T2, the drive signal HE is changed to a low level. In this status, when a high-level signal is outputted from the output CNO, the electrical connection between the recording signal input terminal H1121, clock signal input terminal H1120 and latch signal input terminal H1122, and the recording apparatus is confirmed. The drive signal HE is made to maintain its low level until a fourth period T4. Afterward, in a third period T3, the latch signal LT is changed to a low level. In this status, when the status of the output CNO is changed from the high level to a low level, the electrical connection between the latch signal input terminal H1123 and the recording apparatus is also confirmed. Afterward, in the fourth period T4, the latch signal LT is returned to the high level, and in the fifth period T5, the drive signal HE is returned to the high level, whereby the connection status confirming processing is completed.

In this manner, it is determined that the electrical connection between the recording head H1000 and the recording apparatus is normal. By performing this connection status confirming processing at the time of turning on the recording apparatus, or before starting a recording operation (at the time of standby), it is possible to prevent recording failure such as recording dot dropouts, or damage etc. of recording head induced by the defective contact.

The operation of the connection status output circuit H1127, and the output signal CNO outputted from the connection status output terminal H1126 will be discussed when a recording operation according to the present embodiment is actually executed.

Figure 4C:
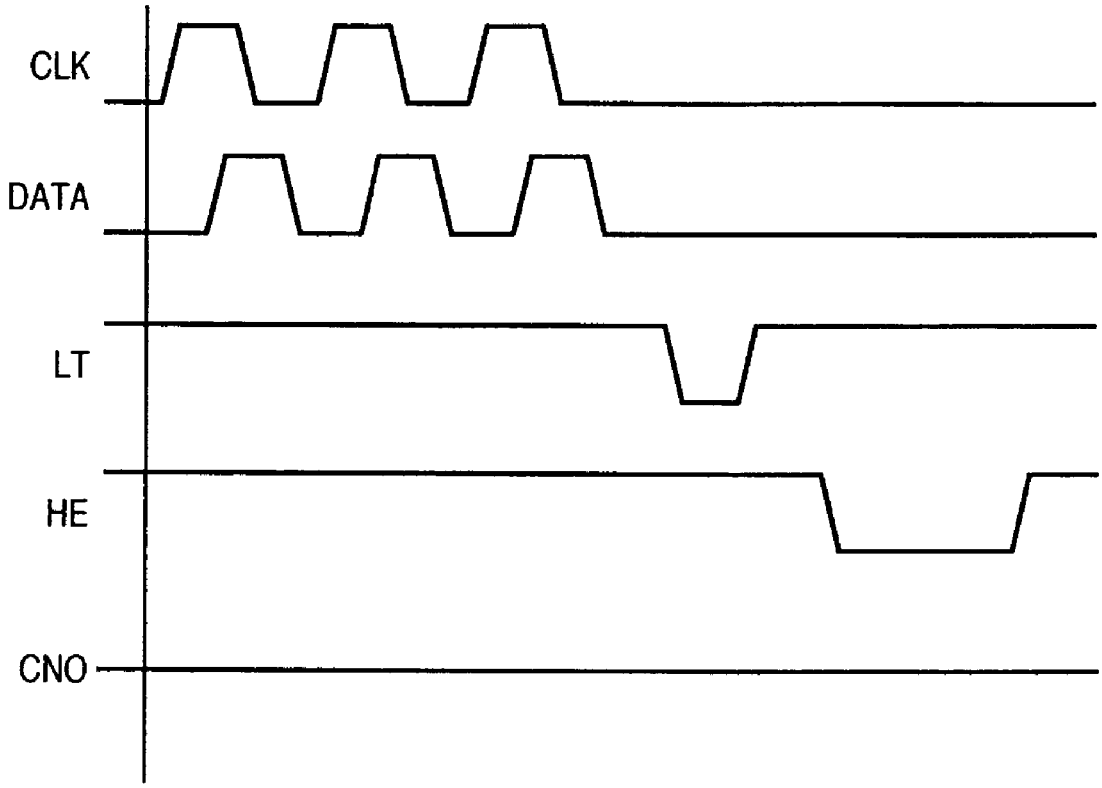
FIG. 4C is a timing chart showing the status of signals when a recording operation is actually executed in the connection status output circuit of FIG. 4A.

FIG. 4C is a timing chart showing the status of each signal when a recording operation according to the present embodiment is actually executed. The timing of the four input signals of the present embodiment is similar to that of First Embodiment. Consequently, while latch signal LT is at a low level, recording signal DATA is not supplied from the recording apparatus to the recording head. Also, control is performed such that, while the drive signal HE is active (at a low level), the recording apparatus does not output the subsequent recording signal DATA.

In the connection status output circuit H1127 according to the present embodiment, when recording signal DATA, clock signal CLK and latch signal LT are changed to a high level, and at the same time, the drive signal HE is changed to a low level, then output CNO is changed to "true (1)". However, as described above, while the drive signal HE is active (at a low level), the subsequent recording signal (DATA) is not supplied from the recording apparatus. Consequently, when a recording operation is actually executed, the output signal CNO from the connection status output circuit H1127 is never changed to "true (1)", and the output signal CNO from the connection status output terminal H1126 is at GND level (no signal) at all times.

As described above, according to the present embodiment, also, similarly to First Embodiment, when a recording operation is executed, the output signal CNO outputted from the connection status output terminal H1126 is at GND level at all times. Thus, noises affecting other signals, particularly recording signal don't occur. Accordingly, the circuit for confirming the connection status between the recording head and the recording apparatus is prevented from having adverse effect on other signals (particularly, recording signal) when recording is actually performed.

Third Embodiment

Third Embodiment of a connection status output circuit according to the recording head of the present invention will be described below. In the following description, an explanation of parts corresponding to First Embodiment described above is omitted, and characteristic parts of the present embodiment are mainly described.

Figure 5A:
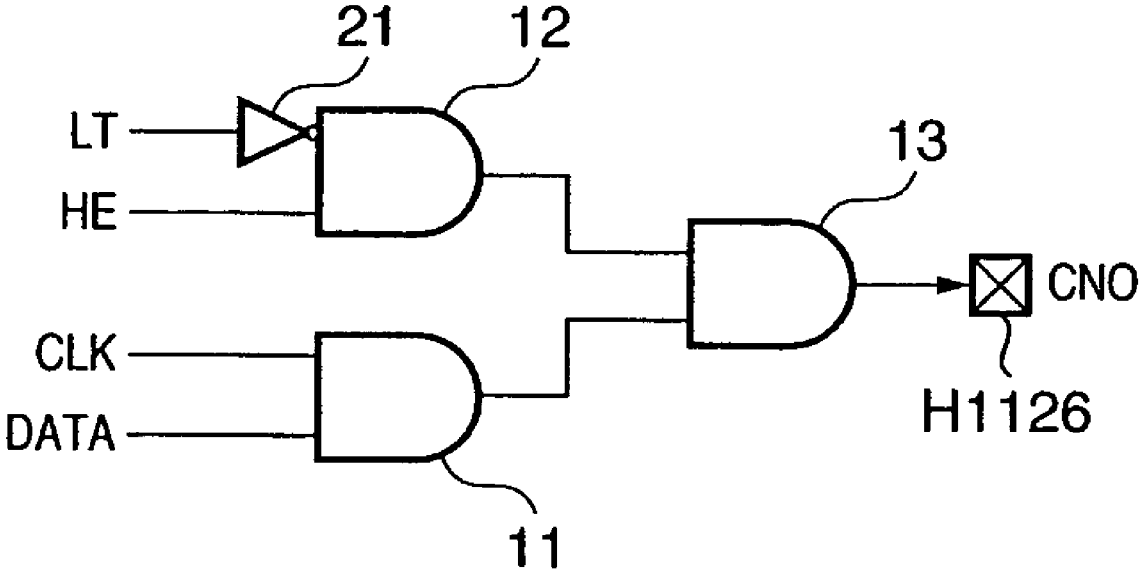
FIG. 5A is a view showing the configuration of a connection status output circuit according to Third Embodiment.
Figure 5B:
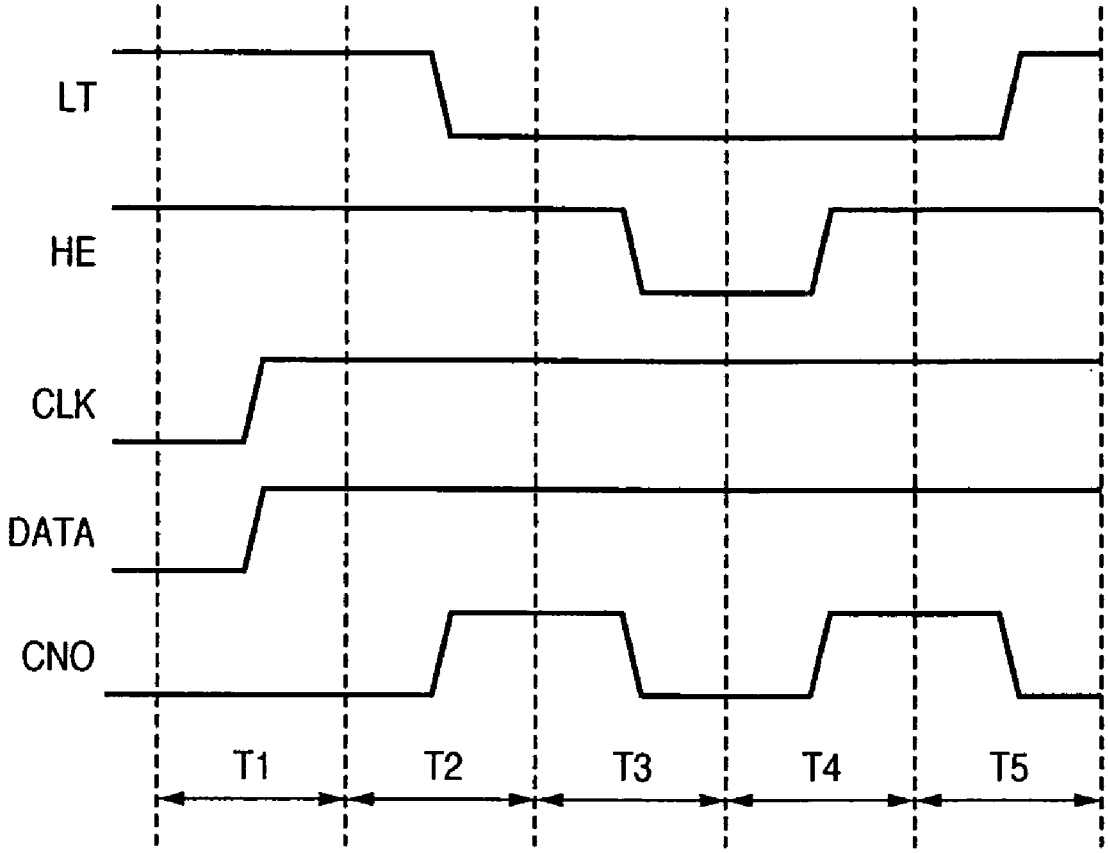
FIG. 5B is a timing chart showing the status of signals when the connection status is confirmed in the connection status output circuit of FIG. 5A.

The configuration of a connection status output circuit according to Third Embodiment shown in FIG. 5A is substantially similar to that of the connection status output circuit according to First Embodiment shown in FIG. 3A. The timing of each signal in a connection status confirming processing shown in FIG. 5B is also similar to that of First Embodiment shown in FIG. 3B.

In the present embodiment, the timing of signals supplied from the recording apparatus when a recording operation is actually executed, is different from that of First Embodiment. More specifically, according to the present embodiment, in order to shorten the time required to receive a recording signal and thereby improve the substantial recording speed, while drive signal HE is active (at a low level), the subsequent recording signal is supplied in synchronization with clock signal CLK.

The operation of the connection status output circuit H1127, and the output signal CNO outputted from the connection status output terminal H1126 will be discussed when a recording operation is actually executed.

Figure 5C:
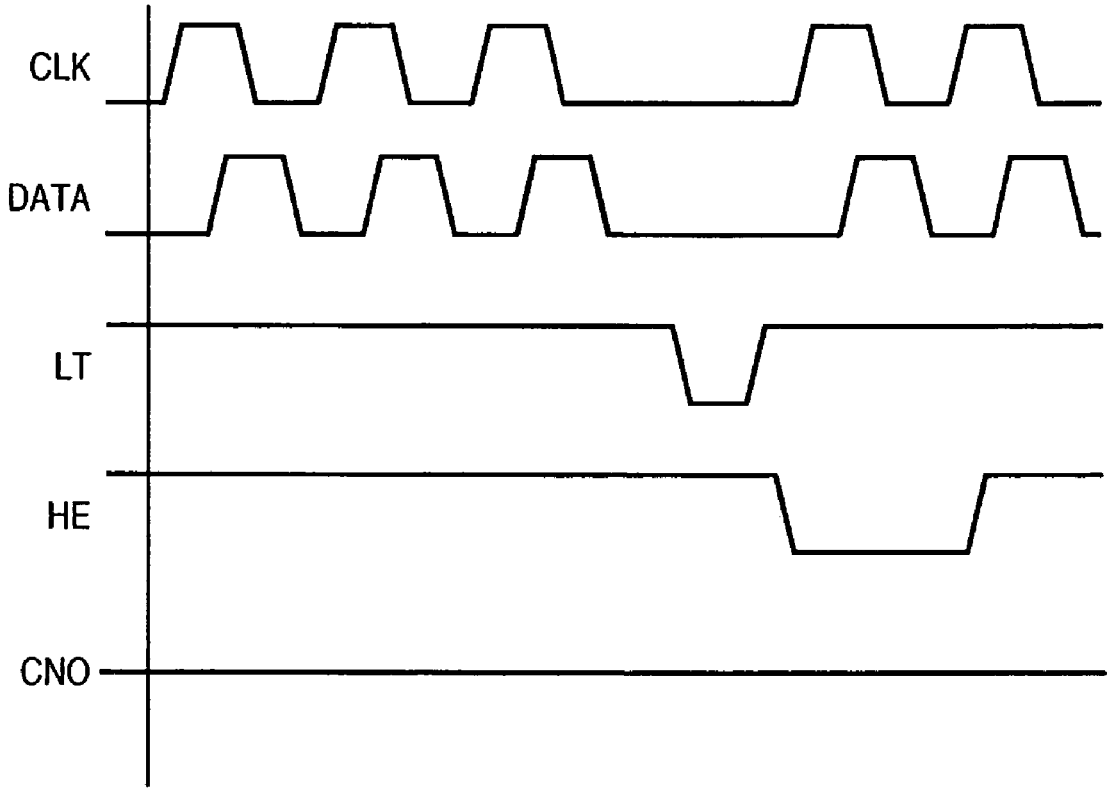
FIG. 5C is a timing chart showing the status of signals when a recording operation is actually executed in the connection status output circuit of FIG. 5A.

FIG. 5C is a timing chart showing the status of each signal when a recording operation is actually performed. The timing of the four input signals of the present embodiment is similar to that of First Embodiment. Consequently, while latch signal LT is at a low level, recording signal DATA is not supplied from the recording apparatus to the recording head. However, according to the present embodiment, while drive signal HE is active (at a low level), also, the subsequent recording signal is supplied from the recording apparatus in synchronization with clock signal CLK.

In the connection status output circuit H1127 according to the present embodiment, when recording signal DATA, clock signal CLK and drive signal HE are changed to a high level, and at the same time, the latch signal LT is changed to a low level, then output signal CNO is changed to "true (1)". However, as described above, while drive signal HE is active (at a low level), recording signal DATA is not supplied from the recording apparatus to the recording head. Consequently, when a recording operation is actually executed, the output signal CNO from the connection status output circuit H1127 is never changed to "true (1)", and the output signal CNO from the connection status output terminal H1126 is at GND level (no signal) at all times.

As described above, according to the present embodiment, even with the configuration in which, while drive signal HE is active (at a low level), the subsequent recording signal is supplied in synchronization with clock signal CLK, an advantageous effect similar to that of First Embodiment described above and high speed data transfer are achieved.

Modification

As for the connection status output circuit, if the connection status between the recording head and the recording apparatus can be confirmed and at the same time, no signal of a frequency related to clock signal is outputted from the connection status confirming output terminal when a recording operation is actually executed, then any configuration other than the above described embodiments may be employed.

For example, in any one of the above described embodiments, a configuration may be employed such that recording signal DATA and clock signal CLK are both inverted and then supplied. More specifically, among the four signals of the connection status output circuit, the three signals other than latch signal LT and drive signal HE are inverted and supplied.

In this case, in addition to a configuration in which respective inverters are provided in the two inputs of the AND 11, a configuration may be employed such that the AND circuit 11 is replaced with a NAND circuit.

Also, in the above described embodiments, when a recording operation is actually executed, the output of the connection status output circuit is made not to change at GND level. However, when a recording operation is actually executed, the output of the connection status output circuit is made not to change at a high level. For example, by installing an inverter at the end of the circuit holding GND, the method is possible.

Other Embodiment

The above embodiments were described by taking as an example, a case where the present invention is applied to an inkjet type recording head using thermal energy and a recording apparatus using the recording head. However, the present invention can be applied to various types of recording heads and recording apparatuses using the same, if those recording heads are detachable to the recording apparatus and have a circuit for confirming the connection status.

For example, the present invention can also be applied to an inkjet type recording head using an electromechanical transducer such as a piezoelectric device, or a recording head other than inkjet type, such as a thermal type.

Additionally, as for the configuration of the recording head, a configuration may be employed such that the recording head is replaced separately from the ink tank; ink is supplied from an ink tank disposed within the recording apparatus to a sub tank disposed in the recording head.

Additionally, the configuration of the inkjet recording apparatus according to the present invention may be any one of the following: one used as an image output apparatus of an information processing device such as a computer; a copy apparatus combined with a reader or the like; a facsimile apparatus having a transmitting/receiving function; a complex machine having a plurality of the functions.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-193083, filed on Jun. 30, 2005, which is hereby incorporated by reference herein in its entirety.

What is claimed is:

1. A recording head detachable to a recording apparatus, comprising:

connecting terminals corresponding respectively to a recording signal, a clock signal for transferring the recording signal, and a control signal for controlling a recording operation according to the recording signal, the signals being received from the recording apparatus; and a connection status output circuit for performing a logical operation between the signals supplied to the connecting terminals, and outputting a signal designating a connection status, wherein the connection status output circuit is configured such that, when the connection status is confirmed, the signal designating the connection status is outputted, and when a recording operation is performed, the output signal does not change.

2. The recording head according to claim 1, wherein the control signal includes at least one of a latch signal for fixing the recording signal received and a drive signal for allowing a recording operation according to the recording signal to be executed.

3. The recording head according to claim 1, wherein the recording signal and the clock signal are positive logic digital signals, and the control signal is a negative logic digital signal.

4. The recording head according to claim 3, wherein the connection status output circuit has an AND circuit calculating a logical product between signals supplied to the circuit, and one of the supplied signals is an inverted signal.

5. The recording head according to claim 1, wherein the connection status output circuit has an AND circuit calculating a logical product between signals supplied to the circuit, and a signal excluding one of the supplied signals is an inverted signal.

6. The recording head according to claim 1, wherein the control signal includes a plurality of signals; and the connection status output circuit includes a first AND circuit calculating a logical product between the recording signal and the clock signal;

a second AND circuit calculating a logical product between the plurality of signals;

a third AND circuit calculating a logical product between outputs of the first and second AND circuits; and an inverter inverting any one of the plurality of signals before being supplied to the second AND circuit.

7. The recording head according to claim 1, further comprising:

a recording element for discharging liquid according to the recording signal.

8. A head cartridge, comprising:

the recording head according to claim 1; and a tank for holding liquid to be discharged and supplying the liquid to the recording head.

9. A recording apparatus which outputs a signal for confirming a connection status and a signal for performing the recording operation, comprising:

the recording head according to claim 1, wherein the recording head records according to the signal for performing the recording operation on a recording medium.

* * * * *